US006366881B1

(12) United States Patent
Inoue

(10) Patent No.: US 6,366,881 B1
(45) Date of Patent: Apr. 2, 2002

(54) VOICE ENCODING METHOD

(75) Inventor: Takeo Inoue, Hirakata (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/367,229

(22) PCT Filed: Feb. 18, 1998

(86) PCT No.: PCT/JP98/00674

§ 371 Date: Aug. 11, 1999

§ 102(e) Date: Aug. 11, 1999

(87) PCT Pub. No.: WO98/37636

PCT Pub. Date: Aug. 27, 1998

(30) Foreign Application Priority Data

Feb. 19, 1997 (JP) ..... 9-035062

(51) Int. Cl.[7] ..... G10L 19/06
(52) U.S. Cl. ..... 704/230; 704/219
(58) Field of Search ..... 704/222, 230, 704/500, 503, 212, 219

(56) References Cited

U.S. PATENT DOCUMENTS 4,686,512 A * 8/1987 Nakamura et al. ..... 341/51
4,754,258 A * 6/1988 Nakamura et al. ..... 341/51
5,072,295 A * 12/1991 Murakami et al. ..... 348/401

FOREIGN PATENT DOCUMENTS

JP 59-178030 10/1984
JP 59-210723 11/1984

OTHER PUBLICATIONS

International Preliminary Examination Report issued in PCT/JP98/00674, dated Apr. 5, 1999.

* cited by examiner

*Primary Examiner*—William Korzuch
*Assistant Examiner*—Abul K. Azad
(74) *Attorney, Agent, or Firm*—Smith, Gambrell & Russell, LLP

(57) ABSTRACT

In a voice coding method for adaptively quantizing a difference $d_n$ between an input signal $x_n$ and a predicted value $y_n$ to code the difference, adaptive quantization is performed such that a reversely quantized value $q_n$ of a code $L_n$ corresponding to a section where the absolute value of the difference $d_n$ is small is approximately zero.

7 Claims, 13 Drawing Sheets

VOICE ENCODING METHOD

TECHNICAL FIELD

The present invention relates generally to a voice coding method, and more particularly, to improvements of an adaptive pulse code modulation (APCM) method and an adaptive differential pulse code modulation (ADPCM) method.

BACKGROUND

As a coding system of a voice signal, an adaptive pulse code modulation (APCM) method and an adaptive difference pulse code modulation (ADPCM) method, and so on have been known.

The ADPCM is a method of predicting the current input signal from the past input signal, quantizing a difference between its predicted value and the current input signal, and then coding the quantized difference. On the other hand, in the ADPCM, a quantization step size is changed depending on the variation in the level of the input signal.

FIG. 11 illustrates the schematic construction of a conventional ADPCM encoder 4 and a conventional ADPCM decoder 5. n used in the following description is an integer.

Description is now made of the ADPCM encoder 4.

A first adder 41 finds a difference (a prediction error signal $d_n$) between a signal $x_n$ signal $y_n$ on the basis of the following equation (1):

$$d_n=x_n-y_n \tag{1}$$

A first adaptive quantizer 42 codes the prediction error signal $d_n$ found by the first adder 41 on the basis of a quantization step size $T_n$, to find a code $L_n$. That is, the first adaptive quantizer 42 finds the code $L_n$ on the basis of the following equation (2). The found code $L_n$ is sent to a memory 6.

$$L_n=[d_n/T_n] \tag{2}$$

In the equation (2), [ ] is Gauss' notation, and represents the maximum integer which does not exceed a number in the square brackets. An initial value of the quantized value $T_n$ is a positive number.

A first quantization step size updating device 43 finds a quantization step size $T_{n+1}$ corresponding the subsequent voice signal sampling value $X_{n+1}$ on the basis of the following equation (3). The relationship between the code $L_n$ and a function M ($L_n$) is as shown in Table 1. Table 1 shows an example in a case where the code $L_n$ is composed of four bits.

$$T_{n+1}=T_n\times M(L_n) \tag{3}$$

TABLE 1

| $L_n$ | | M ($L_n$) |
|---|---|---|
| 0 | −1 | 0.9 |
| 1 | −2 | 0.9 |
| 2 | −3 | 0.9 |
| 3 | −4 | 0.9 |
| 4 | −5 | 1.2 |
| 5 | −6 | 1.6 |
| 6 | −7 | 2.0 |
| 7 | −8 | 2.4 |

A first adaptive reverse quantizer 44 reversely quantizes the prediction error signal $d_n$ using the code $L_n$, to find a reversely quantized value $q_n$. That is, the first adaptive reverse quantizer 44 finds the reversely quantized value $q_n$ on the basis of the following equation (4):

$$q_n=(L_n+0.5)\times T_n \tag{4}$$

A second adder 45 finds a reproducing signal $w_n$ the basis of the predicting signal $y_n$ ponding to the current voice signal sampling $x_n$ and the reversely quantized value $q_n$. That is, the second adder 45 finds the reproducing signal $w_n$ on the basis of the following equation (5):

$$w_n=y_n+q_n \tag{5}$$

A first predicting device 46 delays the reproducing signal $w_n$ by one sampling time, to find a predicting signal $y_{n+1}$ corresponding to the subsequent voice signal sampling value $x_{+1}$.

Description is now made of the ADPCM decoder 5.

A second adaptive reverse quantizer 51 uses a code $L_n'$ obtained from the memory 6 and a quantization step size $T_n'$ obtained by a second quantization step size updating device 52, to find a reversely quantized value $q_n'$ on the basis of the following equation (6).

$$q_n'=(L_n'+0.5)\times T_n' \tag{6}$$

If $L_n$ found in the ADPCM encoder 4 is correctly transmitted to the ADPCM decoder 5, that is, $L_n=L_n'$, the values of $q_n'$, $y_n'$, $T_n'$ and $w_n'$ used on the side of the ADPCM decoder 5 are respectively equal to the values of $q_n$, $y_n$, $T_n$ and $w_n$ used on the side of the ADPCM encoder 4.

The second quantization step size updating device 52 uses the code $L_n'$ obtained from the memory 6, to find a quantization step size $T_{n+1}'$ used with respect to the subsequent code $L_{n+1}'$ on the basis of the following equation (7) The relationship between $L_n'$ and a function M ($L_n'$) in the following equation (7) is the same as the relationship between $L_n$ and the function M ($L_n$) in the foregoing Table 1.

$$T_{n+1}'=T_n'\times M(L_n') \tag{7}$$

A third adder 53 finds a reproducing signal $w_n'$ on the basis of a predicting signal $y_n'$ obtained by a second predicting device 54 and the reversely quantized value $q_n'$. That is, the third adder 53 finds the reproducing signal $w_n'$ on the basis of the following equation (8). The found reproducing signal $w_n'$ is outputted from the ADPCM decoder 5.

$$w_n'=y_n'+q_n' \tag{8}$$

The second predicting device 54 delays the reproducing signal $w_n'$ by one sampling time, to find the subsequent predicting signal $y_{n+1}'$, and sends the predicting signal $y_{n+1}'$ to the third adder 53.

FIGS. 12 and 13 illustrate the relationship between the reversely quantized value $q_n$ and the prediction error signal $d_n$ in a case where the code $L_n$ is composed of three bits.

T in FIG. 12 and U in FIG. 13 respectively represent quantization step sizes determined by the first quantization step size updating device 43 at different time points, where it is assumed that T<U.

In a case where the range A to B of the prediction error signal $d_n$ is indicated by A and B, the range is indicated by "[A" when a boundary A is included in the range, while being indicated by "(A" when it is not included therein. Similarly, the range is indicated by "B]" when a boundary B is included in the range, while being indicated by "B)" when it is not included therein.

In FIG. 12, the reversely quantized value $q_n$ is 0.5T when the value of the prediction error signal $d_n$ is in the range of [0, T), 1.5T when it is in the range of [T, 2T), 2.5T when it is in the range of [2T, 3T) and 3.5T when it is in the range of [3T, ∞].

The reversely quantized value $q_n$ is −0.5T when the value of the prediction error signal $d_n$ is in the range of [−T, 0), −1.5T when it is in the range of [−2T, −T) −2.5 when it is in the range of [−3T, −2T), and −3.5T when it is in the range of [−∞, −3T)

In the relationship between the reversely quantized value $q_n$ and the prediction error signal $d_n$ in FIG. 13, T in FIG. 12 is replaced with U. As shown in FIGS. 12 and 13, the relationship between the reversely quantized value $q_n$ and the prediction error signal $d_n$ is so determined that the characteristics are symmetrical in a positive range and a negative range of the prediction error signal $d_n$ in the prior art. As a result, even when the prediction error signal $d_n$ is small, the reversely quantized value $q_n$ is not zero.

As can be seen from the equation (3) and Table 1, when the code $L_n$ becomes large, the quantization step size $T_n$ is made large. That is, the quantization step size is made small as shown in FIG. 12 when the prediction error signal $d_n$ is small, while being made large as shown in FIG. 13 when the prediction error signal $d_n$ is large.

In a voice signal, there exist a lot of silent sections where the prediction error signal $d_n$ is zero. In the above-mentioned prior art, however, even when the prediction error signal $d_n$ is zero, the reversely quantized value $q_n$ is 0.5T(or 0.5U) which is not zero, so that an quantizing error is increased.

In the above-mentioned prior art, even if the absolute value of the prediction error signal $d_n$ is rapidly changed from a large value to a small value, a large value corresponding to the previous prediction error signal $d_n$ whose absolute value is large is maintained as the quantization step size, so that the quantizing error is increased. That is, in a case where the quantization step size is a relatively large value U as shown in FIG. 13, even if the absolute value of the prediction error signal $d_n$ is rapidly decreased to a value close to zero, the reversely quantized value $q_n$ is 0.5U which is a large value, so that the quantizing error is increased.

Furthermore, even if the absolute value of the prediction error signal $d_n$ is rapidly changed from a small value to a large value, a small value corresponding to the previous prediction error signal $d_n$ whose absolute value is small is maintained as the quantization step size, so that the quantizing error is increased.

Such a problem similarly occurs even in APCM using an input signal as it is in place of the prediction error signal $d_n$.

An object of the present invention is to provide a voice coding method capable of decreasing a quantizing error when a prediction error signal $d_n$ is zero or an input signal is rapidly changed.

DISCLOSURE OF THE INVENTION

A first voice coding method according to the present invention is a voice coding method for adaptively quantizing a difference $d_n$ between an input signal $x_n$ and a predicted value $y_n$ to code the difference, characterized in that adaptive quantization is performed such that a reversely quantized value $q_n$ of a code $L_n$ corresponding to a section where the absolute value of the difference $d_n$ is small is approximately zero.

A second voice coding method according to the present invention is characterized by comprising the first step of adding, when a first prediction error signal $d_n$ which is a difference between an input signal $x_n$ and a predicted value $y_n$ corresponding to the input signal $x_n$ is not less than zero, one-half of a quantization step size $T_n$ to the first prediction error signal $d_n$ to produce a second prediction error signal $e_n$, while subtracting, when the first prediction error signal dais less than zero, one-half of the quantization step size $T_n$ from the first prediction error signal $d_n$ to produce a second prediction error signal $e_n$, the second step of finding a code $L_n$ on the basis of the second prediction error signal $e_n$ found in the first step and the quantization step size $T_n$, the third step of finding a reversely quantized value $q_n$ on the basis of the code $L_n$ found in the second step, the fourth step of finding a quantization step size $T_{n+1}$ corresponding to the subsequent input signal $x_{n+1}$ on the basis of the code $L_n$ found in the second step, and the fifth step of finding a predicted value $y_{n+1}$ corresponding to the subsequent input signal $x_{n+1}$ on the basis of the reversely quantized value $q_n$ found in the third step and the predicted value $y_n$.

In the second step, the code $L_n$ is found on the basis of the following equation (9), for example:

$$L_n=[e_n/T_n] \tag{9}$$

where [ ] is Gauss' notation, and represents the maximum integer which does not exceed a number in the square brackets.

In the third step, the reversely quantized value $q_n$ is found on the basis of the following equation (10), for example:

$$q_n=L_n\times T_n \tag{10}$$

In the fourth step, the quantization step size $T_{n+1}$ is found on the basis of the following equation (11), for example:

$$T_{n+1}=T_n\times M(L_n) \tag{11}$$

where M ($L_n$) is a value determined depending on $L_n$.

In the fifth step, the predicted value $y_{n+1}$ is found on the basis of the following equation (12), for example:

$$y_{n+1}=y_n+q_n \tag{12}$$

A third voice coding method according to the present invention is a voice coding method for adaptively quantizing a difference $d_n$ between an input signal $x_n$ and a predicted value $y_n$ to code the difference, characterized in that adaptive quantization is performed such that a reversely quantized value $q_n$ of a code $L_n$ corresponding to a section where the absolute value of the difference $d_n$ is small is approximately zero, and a quantization step size corresponding to a section where the absolute value of the difference $d_n$ is large is larger, as compared with that corresponding to the section where the absolute value of the difference $d_n$ is small.

A fourth voice coding method according to the present invention is characterized by comprising the first step of adding, when a first prediction error signal $d_n$ which is a difference between an input signal $x_n$ and a predicted value $y_n$ corresponding to the input signal $x_n$ is not less than zero, one-half of a quantization step size $T_n$ to the first prediction error signal $d_n$ to produce a second prediction error signal $e_n$, while subtracting, when the first prediction error signal $d_n$ is less than zero, one-half of the quantization step size $T_n$ from the first prediction error signal $d_n$ to produce a second prediction error signal $e_n$, the second step of finding, on the basis of the second prediction error signal $e_n$ found in the first step and a table previously storing the relationship between the second prediction error signal $e_n$ and a code $L_n$, the code $L_n$, the third step of finding, on the basis of the code $L_n$ found in the second step and a table previously storing the relationship between the code $L_n$ and a reversely quantized value $q_n$, the reversely quantized value $q_n$, the fourth step of finding, on the basis of the code $L_n$ found in the second step and a table previously storing the relationship between the code $L_n$ and a quantization step size $T_{n+1}$ corresponding to the subsequent input signal $x_{n+1}$, the quantization step size $T_{n+1}$ corresponding to the subsequent input signal $x_{n+1}$, and the fifth step of finding a predicted value $y_{n+1}$ corresponding to the subsequent input signal $x_{n+1}$ on the basis of the reversely quantized value $q_n$ found in the third step and the predicted value $y_n$, wherein each of the tables is produced so as to satisfy the following conditions (a), (b) and (c):

(a) The quantization step size $T_n$ is so changed as to be increased when the absolute value of the difference $d_n$ is so changed as to be increased, (b) The reversely quantized value $q_n$ of the code $L_n$ corresponding to a section where the absolute value of the difference $d_n$ is small is approximately zero, and (c) A substantial quantization step size corresponding to a section where the absolute value of the difference $d_n$ is large is larger, as compared with that corresponding to the section where the a absolute value of the difference $d_n$ is small.

In the fifth step, the predicted value $y_{n+1}$ is found on the basis of the following equation (13), for example:

$$y_{n+1}=y_n+q_n \tag{13}$$

A fifth voice coding method according to the present invention is a voice coding method for adaptively quantizing an input signal $x_n$ to code the input signal, characterized in that adaptive quantization is performed such that a reversely quantized value of a code $L_n$ corresponding to a section where the absolute value of the input signal $x_n$ is small is approximately zero.

A sixth voice coding method according to the present invention is characterized by comprising the first step of adding one-half of a quantization step size $T_n$ to an input signal $x_n$ to produce a corrected input signal $g_n$ when the input signal $x_n$ is not less than zero, while subtracting one-half of the quantization step size $T_n$ from the input signal $x_n$ to produce a corrected input signal $g_n$ when the input signal $x_n$ is less than zero, the second step of finding a code $L_n$ on the basis of the corrected input signal $g_n$ found in the first step and the quantization step size $T_n$, the third step of finding a quantization step size $T_{n+1}$ corresponding to the subsequent input signal $x_{n+1}$ on the basis of the code $L_n$ found in the second step, and the fourth step of finding a reproducing signal $w_n'$ on the basis of the code $L_n'(=L_n)$ found in the second step.

In the second step, the code $L_n$ is found on the basis of the following equation (14), for example:

$$L_n=[g_n/T_n] \tag{14}$$

where [ ] is Gauss' notation, and represents the maximum integer which does not exceed a number in the square brackets.

In the third step, the quantization step size $T_{n+1}$ is found on the basis of the following equation (15), for example:

$$T_{n+1}=T_n\times M(L_n) \tag{15}$$

where $M(L_n)$ is a value determined depending on $L_n$.

In the fourth step, the reproducing signal $w_n'$ is found on the basis of the following equation (16), for example:

$$w_n'=L_n'(=L_n)\times T_n' \tag{16}$$

A seventh voice coding method according to the present invention is a voice coding method for adaptively quantizing an input signal $x_n$ to code the input signal, characterized in that adaptive quantization is performed such that a reversely quantized value $q_n$ of a code $L_n$ corresponding to a section where the absolute value of the input signal $x_n$ is small is approximately zero, and a quantization step size corresponding to a section where the absolute value of the input signal $x_n$ is large is larger, as compared with that corresponding to the section where the absolute value of the input signal $x_n$ is small.

An eighth voice coding method according to the present invention is characterized by comprising the first step of adding one-half of a quantization step size $T_n$ to an input signal $x_n$ to produce a corrected input signal $g_n$ when the input signal $d_n$ is not less than zero, while subtracting one-half of the quantization step size $T_n$ from the input signal $x_n$ to produce a corrected input signal $g_n$ when the input signal $x_n$ is less than zero, the second step of finding, on the basis of the corrected input signal $g_n$ found in the first step and a table previously storing the relationship between the signal $g_n$ and a code $L_n$, the code $L_n$, the third step of finding, on the basis of the code $L_n$ found in the second step and a table previously storing the relationship between the code $L_n$ and a quantization step size $T_{n+1}$ corresponding to the subsequent input signal $x_{n+1}$, the quantization step size $T_{n+1}$ corresponding to the subsequent input signal $x_{n+1}$, and the fourth step of finding, on the basis of the code $L_n'(=L_n)$ found in the second step and a table storing the relationship between the code $L_n'(=L_n)$ and a reproducing signal $w_n'$, the reproducing signal $w_n'$, wherein each of the tables is produced so as to satisfy the following conditions (a), (b) and (c):

(a) The quantized value $T_n$ is so changed as to be increased when the absolute value of the input signal $x_n$ is so changed as to be increased, (b) The reversely quantized value $q_n$ of the code $L_n$ corresponding to a section where the absolute value of the input signal $x_n$ is small is approximately zero, and (c) A substantial quantization step size corresponding to a section where the absolute value of the input signal $x_n$ is large is made larger, as compared with that corresponding to the section where the absolute value of the input signal $x_n$ is small.

BEST MODE FOR CARRYING OUT THE INVENTION

[1] Description of First Embodiment

Referring now to FIGS. 1 to 5, a first embodiment of the present invention will be described.

Figure 1:
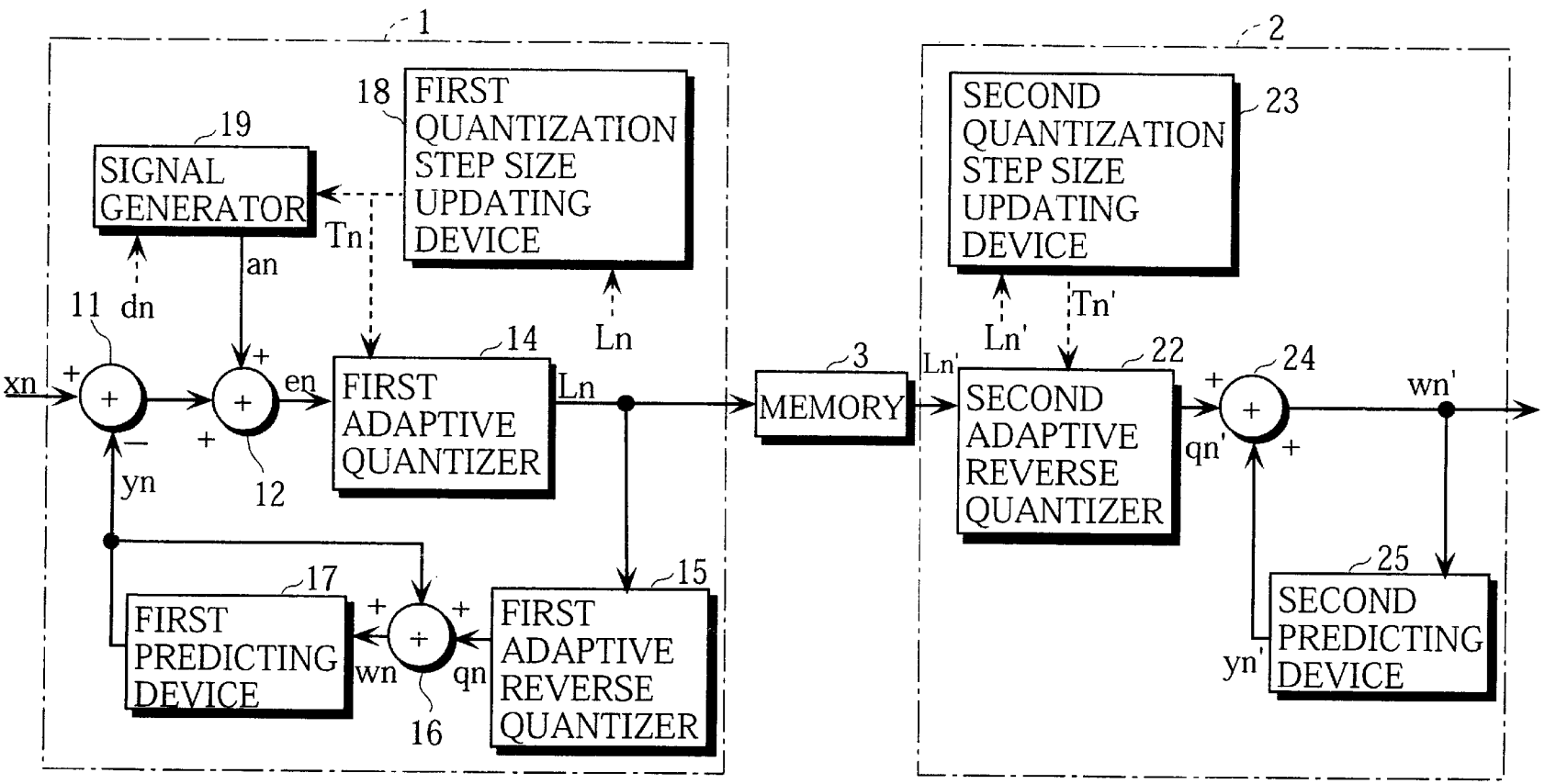
FIG. 1 is a block diagram showing a first embodiment of the present invention.

FIG. 1 illustrates the schematic construction of an ADPCM encoder 1 and an ADPCM decoder 2. n used in the following description is an integer.

Description is now made of the ADPCM encoder 1. A first adder 11 finds a difference (hereinafter referred to as a first prediction error signal $d_n$) between a signal $x_n$ inputted to the ADPCM encoder 1 and a predicting signal $y_n$ on the basis of the following equation (17):

$$d_n=x_n-y_n \tag{17}$$

A signal generator 19 generates a correcting signal $a_n$ on the basis of the first prediction error signal $d_n$ and a quantization step size $T_n$ obtained by a first quantization step size updating device 18. That is, the signal generator 19 generates the correcting signal $a_n$ on the basis of the following equation (18):

$$\text{in the case of } d_n \geqq 0\text{: } a_n=T_n/2$$

$$\text{in the case of } d_n<0\text{: } a_n=-T_n/2 \tag{18}$$

A second adder 12 finds a second prediction error signal $e_n$ on the basis of the first prediction error signal $d_n$ and the correcting signal $a_n$ obtained by the signal generator 19. That is, the second adder 12 finds the second prediction error signal $e_n$ on the basis of the following equation (19):

$$e_n=d_n+a_n \tag{19}$$

Consequently, the second prediction error signal $e_n$ is expressed by the following equation (20):

$$\text{in the case of } d_n \geqq 0\text{: } e_n=d_n+T_n/2$$

$$\text{in the case of } d_n<0\text{: } e_n=d_n-T_n/2 \tag{20}$$

A first adaptive quantizer 14 codes the second prediction error signal $e_n$ found by the second adder 12 on the basis of the quantization step size $T_n$ obtained by the first quantization step size updating device 18, to find a code $L_n$. That is, the first adaptive quantizer 14 finds the code $L_n$ on the basis of the following equation (21). The found code $L_n$ is sent to a memory 3.

$$L_n=[e_n/T_n] \tag{21}$$

In the equation (21), [ ] is Gauss' notation, and represents the maximum integer which does not exceed a number in the square brackets. An initial value of the quantization step size $T_n$ is a positive number.

The first quantization step size updating device 18 finds a quantization step size $T_{n+1}$ corresponding the subsequent voice signal sampling value $X_{n+1}$ on the basis of the following equation (22). The relationship between the code $L_n$ and a function M ($L_n$) is the same as the relationship between the code $L_n$ and the function M ($L_n$) in the foregoing Table 1.

$$T_{n+1}=T_n\times M(L_n) \tag{22}$$

A first adaptive reverse quantizer 15 find a reversely quantized value $q_n$ on the basis of the following equation (23).

$$q_n=L_n\times T_n \tag{23}$$

A third adder 16 finds a reproducing signal $w_n$ on the basis of the predicting signal $y_n$ corresponding to the current voice signal sampling value $x_n$ and the reversely quantized value $q_n$. That is, the third adder 16 finds the reproducing signal $w_n$ on the basis of the following equation (24):

$$w_n=y_n+q_n \tag{24}$$

A first predicting device 17 delays the reproducing signal $w_n$ by one sampling time, to find a predicting signal $y_{n+1}$ corresponding to the subsequent voice signal sampling value $x_{n+1}$.

Description is now made of the ADPCM decoder 2.

A second adaptive reverse quantizer 22 uses a code $L_n'$ obtained from the memory 3 and a quantization step size $T_n'$ obtained by a second quantization step size updating device 23, to find a reversely quantized value $q_n'$ on the basis of the following equation (25).

$$q_n'L_n'\times T_n' \tag{25}$$

If $L_n$ found in the ADPCM encoder 1 is correctly transmitted to the ADPCM decoder 2, that is, $L_n=L_n'$, the values of $q_n'$, $y_n'$, $T_n'$ and $w_n'$ used on the side of the ADPCM decoder 2 are respectively equal to the values of $q_n$, $y_n$, $T_n$ and $w_n$ used on the side of the ADPCM encoder 1.

The second quantization step size updating device 23 uses the code $L_n'$ obtained from the memory 3, to find a quantization step size $T_{n+1}'$ used with respect to the subsequent code $L_{n+1}'$ on the basis of the following equation (26). The relationship between the code $L_n'$ and a function M ($L_n'$) is the same as the relationship between the code $L_n$ and the function M ($L_n$) in the foregoing Table 1.

$$T_{n+1}'=T_n'\times M(L_n') \tag{26}$$

A fourth adder 24 finds a reproducing signal $w_n'$ on the basis of a predicting signal $y_n'$ obtained by a second predicting device 25 and the reversely quantized value $q_n'$. That is, the fourth adder 24 finds the reproducing signal $w_n'$ on the basis of the following equation (27). The found reproducing signal $w_n'$ is outputted from the ADPCM decoder 2.

$$w_n'=y_n'+q_n' \tag{27}$$

The second predicting device 25 delays the reproducing signal $w_n'$ by one sampling time, to find the subsequent predicting signal $y_{n+1}'$, and sends the predicting signal $y_{n+1}'$ to the fourth adder 24.

Figure 2:
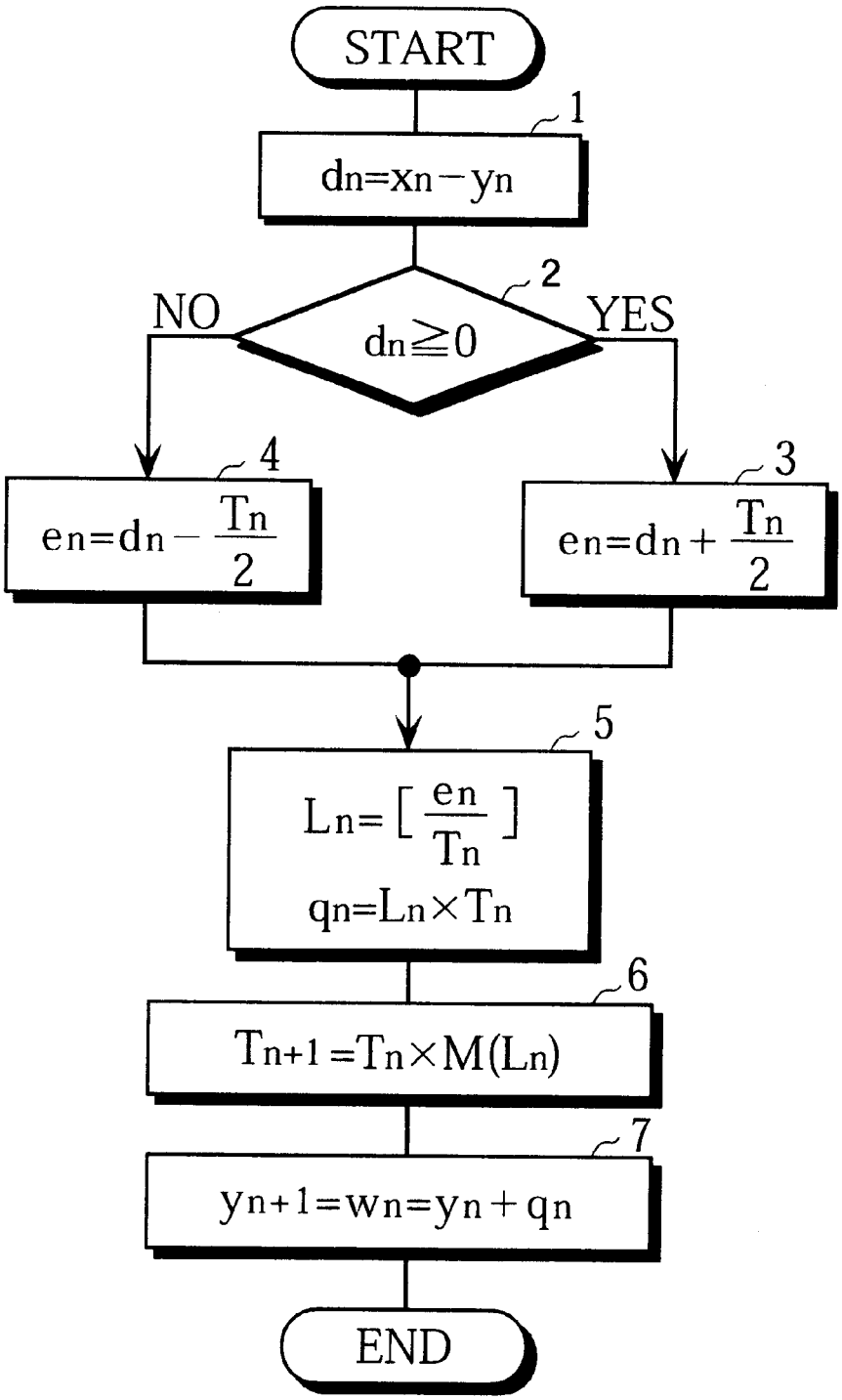
FIG. 2 is a flow chart showing operations performed by an ADPCM encoder shown in FIG. 1.

FIG. 2 shows the procedure for operations performed by the ADPCM encoder 1.

The predicting signal $y_n$ is first subtracted from the input signal $x_n$, to find the first prediction error signal $d_n$ (step 1).

It is then judged whether the first prediction error signal $d_n$ is not less than zero or less than zero (step 2). When the first prediction error signal $d_n$ is not less than zero, one-half of the quantization step size $T_n$ is added to the first prediction error signal $d_n$, to find the second prediction error signal $e_n$ (step 3).

When the first prediction error signal $d_n$ is less than zero, one-half of the quantization step size $T_n$ is subtracted from the first prediction error signal $d_n$, to find the second prediction error signal $e_n$ (step 4).

When the second prediction error signal $e_n$ is found in the step 3 or the step 4, coding based on the foregoing equation (21) and reverse quantization based on the foregoing equation (23) are performed (step 5). That is, the code $L_n$ and the reversely quantized value $q_n$ are found.

The quantization step size $T_n$ is then updated on the basis of the foregoing equation (22) (step 6). The predicting signal $y_{n+1}$ corresponding to the subsequent voice signal sampling value $x_{n+1}$ is found on the basis of the foregoing equation (24) (step 7).

Figure 3:
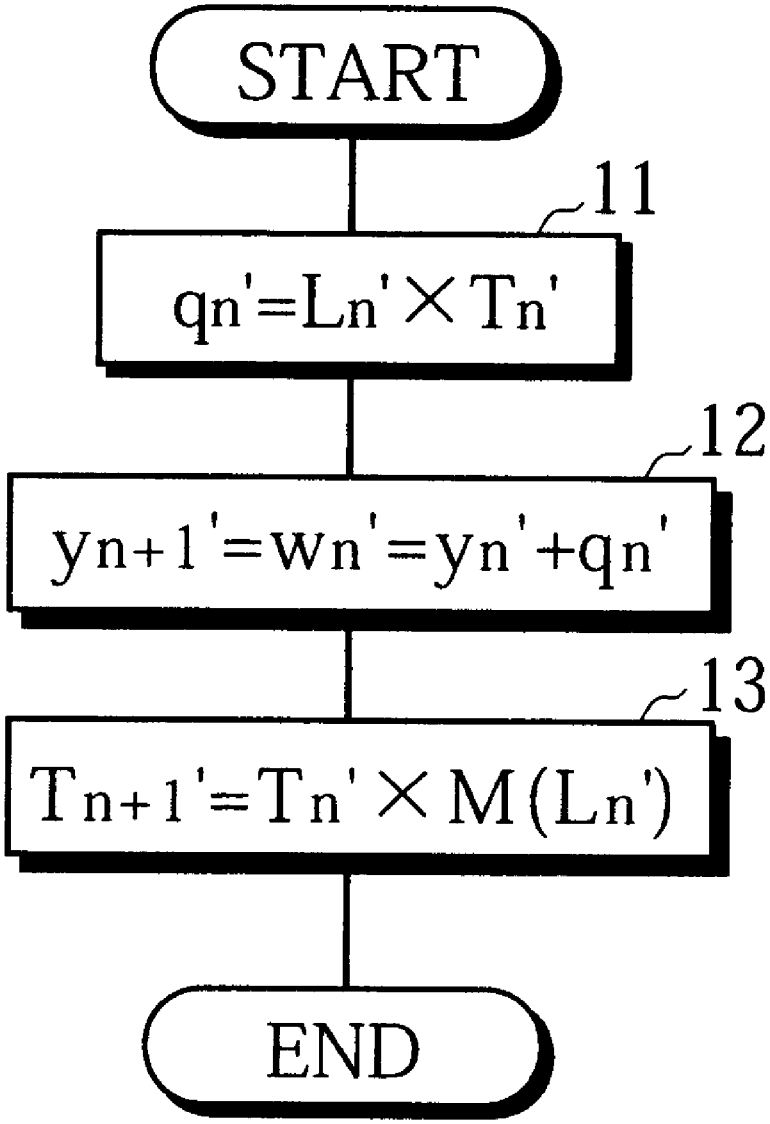
FIG. 3 is a flow chart showing operations performed by an ADPCM decoder shown in FIG. 1.

FIG. 3 shows the procedure for operations performed by the ADPCM decoder 2.

The code $L_n'$ is first read out from the memory 3, to find the reversely quantized value $q_n'$ on the basis of the foregoing equation (25) (step 11).

Thereafter, the subsequent predicting signal $Y_{n+1}'$ is found on the basis of the foregoing equation (27) (step 12).

The quantization step size $T_{n+1}'$ used with respect to the subsequent code $L_{n+1}'$ is found on the basis of the foregoing equation (26) (step 13).

Figure 4:
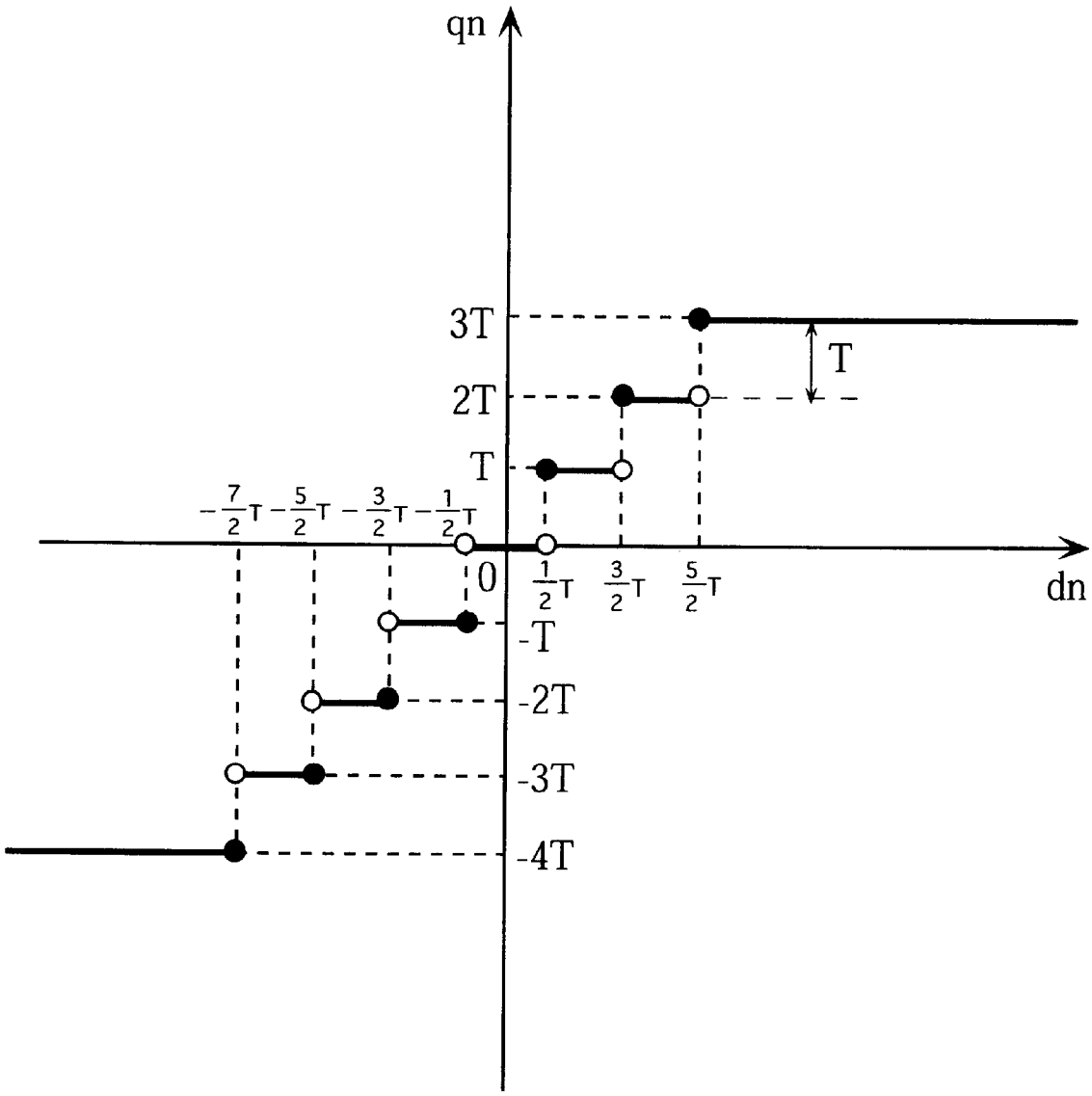
FIG. 4 is a graph showing the relationship between a prediction error signal $d_n$ and a reversely quantized value $q_n$.
Figure 5:
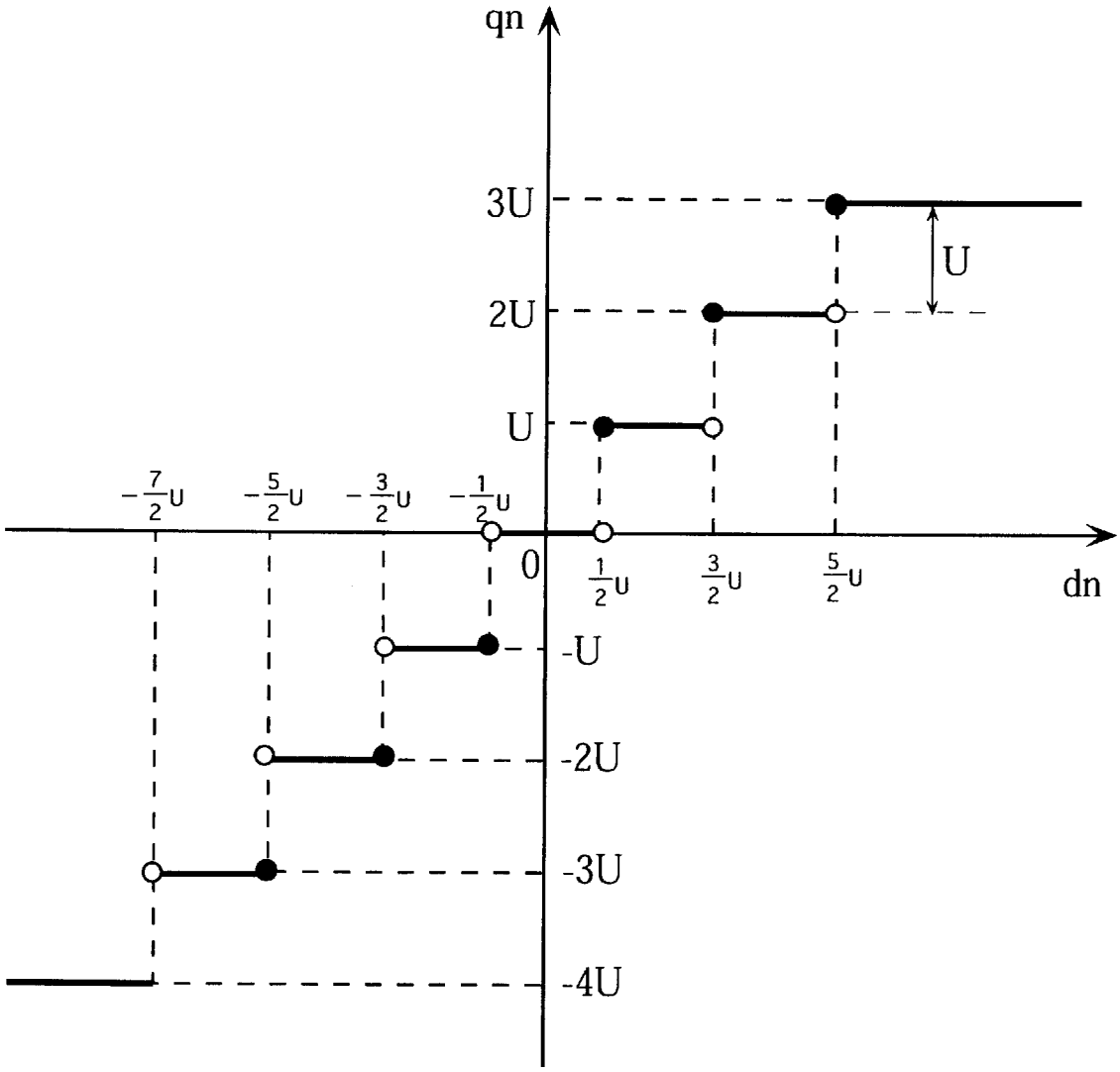
FIG. 5 is a graph showing the relationship between a prediction error signal $d_n$ and a reversely quantized value $q_n$.

FIGS. 4 and 5 illustrate the relationship between the reversely quantized value $q_n$ obtained by the first adaptive reverse quantizer 15 in the ADPCM encoder 1 and the first prediction error signal $d_n$ in a case where the code $L_n$ is composed of three bits.

T in FIG. 4 and U in FIG. 5 respectively represent quantization step sizes determined by the first quantization step size updating device 18 at different time points, where it is assumed that T<U.

In a case where the range A to B of the first prediction error signal $d_n$ is indicated by A and B, the range is indicated by "[A" when a boundary A is included in the range, while being indicated by "(A" when it is not included therein. Similarly, the range is indicated by "B]" when a boundary B is included in the range, while being indicated by "B)" when it is not included therein.

In FIG. 4, the reversely quantized value $q_n$ is n zero when the value of the first prediction error signal $d_n$ is in the range of (−0.5T, 0.5T) T when it is in the range of [0.5T, 1.5T), 2T when it is in the range of [1.5T, 2.5T), and 3T when it is in the range of [2.5T, ∞].

Furthermore, the reversely quantized value $q_n$ is −T when the value of the first prediction error signal $d_n$ is in the range of (−1.5T, −0.5T], −2T when it is in the range of (−2.5T, −1.5T], −3T when it is in the range of (−3.5T, −2.5T], and −4T when it is in the range of [∞, −3.5T].

In the relationship between the reversely quantized value $q_n$ and the first prediction error signal $d_n$ in FIG. 5, T in FIG. 4 is replaced with U.

Also in the first embodiment, when the code $L_n$ becomes large, the quantization step size $T_n$ is made large, as can be seen from the foregoing equation (22) and Table 1. That is, the quantization step size is made small as shown in FIG. 4 when the prediction error signal $d_n$ is small, while being made large as shown in FIG. 5 when it is large.

According to the first embodiment, when the prediction error signal $d_n$ which is a difference between the input signal $x_n$ and the predicting signal $y_n$ is zero, the reversely quantized value $q_n$ is zero. When the prediction error signal $d_n$ is zero as in a silent section of a voice signal, therefore, a quantizing error is decreased.

When the absolute value of the first prediction error signal $d_n$ is rapidly changed from a large value to a small value, a large value corresponding to the previous prediction error signal $d_n$ whose absolute value is large is maintained as the quantization step size. However, the reversely quantized value $q_n$ can be made zero, so that the quantizing error is decreased. That is, in a case where the quantization step size is a relatively large value U as shown in FIG. 5, when the absolute value of the prediction error signal $d_n$ is rapidly decreased to a value close to zero, the reversely quantized value $q_n$ is zero, so that the quantizing error is decreased.

[2] Description of Second Embodiment

Referring now to FIGS. 6 to 9, a second embodiment of the present invention will be described.

Figure 6:
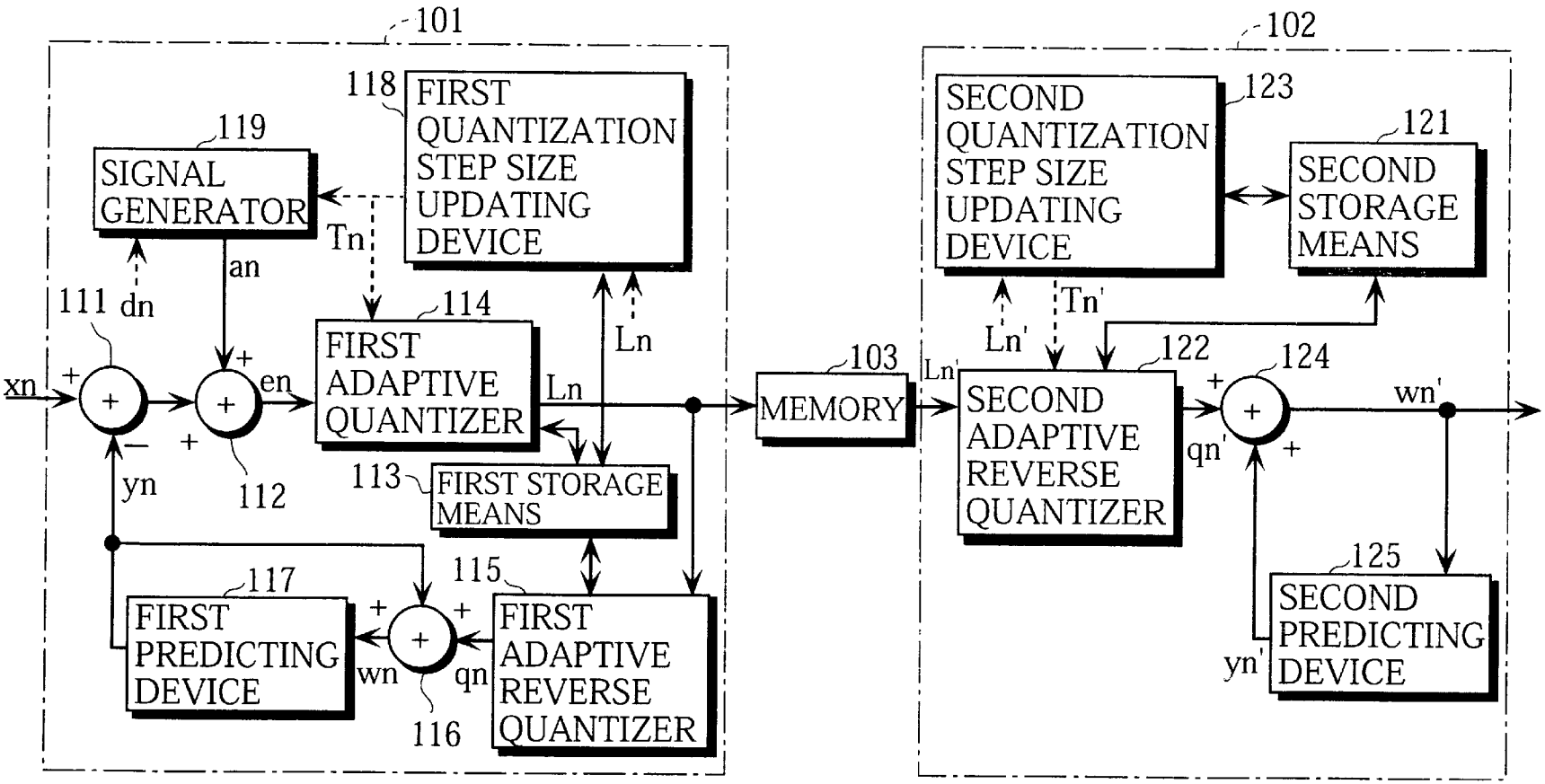
FIG. 6 is a block diagram showing a second embodiment of the present invention.

FIG. 6 illustrates the schematic construction of an ADPCM encoder 101 and an ADPCM decoder 102. n used in the following description is an integer.

Description is now made of the ADPCM encoder 101.

The ADPCM encoder 101 comprises first storage means 113. The first storage means 113 stores a translation table as shown in Table 2. Table 2 shows an example in a case where a code $L_n$ is composed of four bits.

TABLE 2

| Second Prediction Error Signal $e_n$ | $L_n$ | $q_n$ | Quantization Step Size $T_{n+1}$ |
|---|---|---|---|
| $11T_n \leqq e_n$ | 0111 | $12T_n$ | $T_{n+1} = T_n \times 2.5$ |
| $8T_n \leqq e_n < 11T_n$ | 0110 | $9T_n$ | $T_{n+1} = T_n \times 2.0$ |
| $6T_n \leqq e_n < 8T_n$ | 0101 | $6.5T_n$ | $T_{n+1} = T_n \times 1.25$ |
| $4T_n \leqq e_n < 6T_n$ | 0100 | $4.5T_n$ | $T_{n+1} = T_n \times 1.0$ |
| $3T_n \leqq e_n < 4T_n$ | 0011 | $3T_n$ | $T_{n+1} = T_n \times 1.0$ |
| $2T_n \leqq e_n < 3T_n$ | 0010 | $2T_n$ | $T_{n+1} = T_n \times 1.0$ |
| $T_n \leqq e_n < 2T_n$ | 0001 | $T_n$ | $T_{n+1} = T_n \times 0.75$ |
| $-T_n < e_n < T_n$ | 0000 | 0 | $T_{n+1} = T_n \times 0.75$ |
| $-2T_n < e_n \leqq -T_n$ | 1111 | $-T_n$ | $T_{n+1} = T_n \times 0.75$ |
| $-3T_n < e_n \leqq -2T_n$ | 1110 | $-2T_n$ | $T_{n+1} = T_n \times 1.0$ |
| $-4T_n < e_n \leqq -3T_n$ | 1101 | $-3T_n$ | $T_{n+1} = T_n \times 1.0$ |
| $-5T_n < e_n \leqq -4T_n$ | 1100 | $-4T_n$ | $T_{n+1} = T_n \times 1.0$ |
| $-7T_n < e_n \leqq -5T_n$ | 1011 | $-5.5T_n$ | $T_{n+1} = T_n \times 1.25$ |
| $-9T_n < e_n \leqq -7T_n$ | 1010 | $-7.5T_n$ | $T_{n+1} = T_n \times 2.0$ |
| $-12T_n < e_n \leqq -9T_n$ | 1001 | $-10T_n$ | $T_{n+1} = T_n \times 2.5$ |
| $e_n \leqq -12T_n$ | 1000 | $-13T_n$ | $T_{n+1} = T_n \times 5.0$ |

The translation table comprises the first column storing the range of a second prediction error signal $e_n$, the second column storing a code $L_n$ corresponding to the range of the second prediction error signal $e_n$ in the first column, the third column storing a reversely quantized value $q_n$ corresponding to the code $L_n$ in the second column, and the fourth column storing a calculating equation of a quantization step size $T_{n+1}$ corresponding to the code $L_n$ in the second column. The quantization step size is a value for determining a substantial quantization step size, and is not the substantial quantization step size itself.

In the second embodiment, conversion from the second prediction error signal $e_n$ to the code $L_n$ in a first adaptive quantizer 114, conversion from the code $L_n$ to the reversely quantized value $q_n$ in a first adaptive reverse quantizer 115, and updating of a quantization step size $T_n$ in a first quantization step size updating device 118 are performed on the basis of the translation table stored in the first storage means 113.

A first adder 111 finds a difference (hereinafter referred to as a first prediction error signal $d_n$) between a signal $x_n$ inputted to the ADPCM encoder 101 and a predicting signal $y_n$ on the basis of the following equation (28):

$$d_n = x_n - y_n \quad (28)$$

A signal generator 119 generates a correcting signal $a_n$ on the basis of the first prediction error signal $d_n$ and the quantization step size $T_n$ obtained by a first quantization step size updating device 118. That is, the signal generator 119 generates a correcting signal $a_n$ on the basis of the following equation (29):

$$\text{in the case of } d_n \geqq 0\text{: } a_n = T_n/2$$

$$\text{in the case of } d_n < 0\text{: } a_n = -T_n/2 \quad (29)$$

A second adder 112 finds a second prediction error signal $e_n$ on the basis of the first prediction error signal $d_n$ and the correcting signal $a_n$ obtained by the signal generator 119. That is, the second adder 112 finds the second prediction error signal $e_n$ on the basis of the following equation (30):

$$e_n = d_n + a_n \quad (30)$$

Consequently, the second prediction error signal $e_n$ is expressed by the following equation (31):

$$\text{in the case of } d_n \geqq 0\text{: } e_n = d_n + T_n/2$$

$$\text{in the case of } d_n < 0\text{: } e_n = d_n - T_n/2 \quad (31)$$

The first adaptive quantizer 114 finds a code $L_n$ on the basis of the second prediction error signal $e_n$ found by the second adder 112 and the translation table. That is, the code $L_n$ corresponding to the second prediction error signal $e_n$ out of the respective codes $L_n$ in the second column of the translation table is read out from the first storage means 113 and is outputted from the first adaptive quantizer 114. The found code $L_n$ is sent to a memory 103.

The first adaptive reverse quantizer 115 finds the reversely quantized value $q_n$ on the basis of the code $L_n$ found by the first adaptive quantizer 114 and the translation table. That is, the reversely quantized value $q_n$ corresponding to the code $L_n$ found by the first adaptive quantizer 114 is read out from the first storage means 113 and is outputted from the first adaptive reverse quantizer 115.

The first quantization step size updating device 118 finds the subsequent quantization step size $T_{n+1}$ on the basis of the code $L_n$ found by the first adaptive quantizer 114, the current quantization step size $T_n$, and the translation table. That is, the subsequent quantization step size $T_{n+1}$ is found on the basis of the quantization step size calculating equation corresponding to the code $L_n$ found by the first adaptive quantizer 114 out of the quantization step size calculating equations in the fourth column of the translation table.

A third adder 116 finds a reproducing signal $w_n$ on the basis of the predicting signal $y_n$ corresponding to the current voice signal sampling value $x_n$ and the reversely quantized value $q_n$. That is, the third adder 116 finds the reproducing signal $w_n$ on the basis of the following equation (32):

$$w_n = y_n + q_n \quad (32)$$

A first predicting device 117 delays the reproducing signal $w_n$ by one sampling time, to find a predicting signal $y_{n+1}$ corresponding to the subsequent voice signal sampling value $x_{n+1}$.

Description is now made of the ADPCM decoder 102.

The ADPCM decoder 102 comprises second storage means 121. The second storage means 121 stores a translation table having the same contents as those of the translation table stored in the first storage means 113.

A second adaptive reverse quantizer 122 finds a reversely quantized value $q_n'$ on the basis of a code $L_n'$ obtained from the memory 103 and the translation table. That is, a reversely quantized value $q_n'$ corresponding to the code $L_n$ in the second column which corresponds to the code $L_n'$ obtained from the memory 103 out of the reversely quantized values $q_n$ in the third column of the translation table is read out from the second storage means 121 and is outputted from the second adaptive reverse quantizer 122.

If $L_n$ found in the ADPCM encoder 101 is correctly transmitted to the ADPCM decoder 2, that is, $L_n = L_n'$, the values of $q_n'$, $y_n'$, $T_n'$ and $w_n'$ used on the side of the ADPCM decoder 102 are respectively equal to the values of $q_n$, $y_n$, $T_n$ and $w_n$ used on the side of the ADPCM encoder 101.

A second quantization step size updating device 123 finds the subsequent quantization step size $T_{n+1}'$ on the basis of the code $L_n'$ obtained from the memory 103, the current quantization step size $T_n'$ and the translation table. That is, the subsequent quantization step size $T_{n+1}'$ is found on the basis of the quantization step size calculating equation corresponding to the code $L_n'$ obtained from the memory 103 out of the quantization step size calculating equations in the fourth column of the translation table.

A fourth adder 124 finds a reproducing signal $w_n'$ on the basis of a predicting signal $y_n'$ obtained by a second predicting device 125 and the reversely quantized value $q_n'$. That is, the fourth adder 124 finds the reproducing signal $w_n'$ on the basis of the following equation (33). The found reproducing signal $w_n'$ is outputted from the ADPCM decoder 102.

$$w_n' = y_n' + q_n' \quad (33)$$

The second predicting device 125 delays the reproducing signal $w_n'$ by one sampling time, to find the subsequent predicting signal $y_{n+1}'$, and sends the predicting signal $y_{n+1}'$ to the fourth adder 124.

Figure 7:
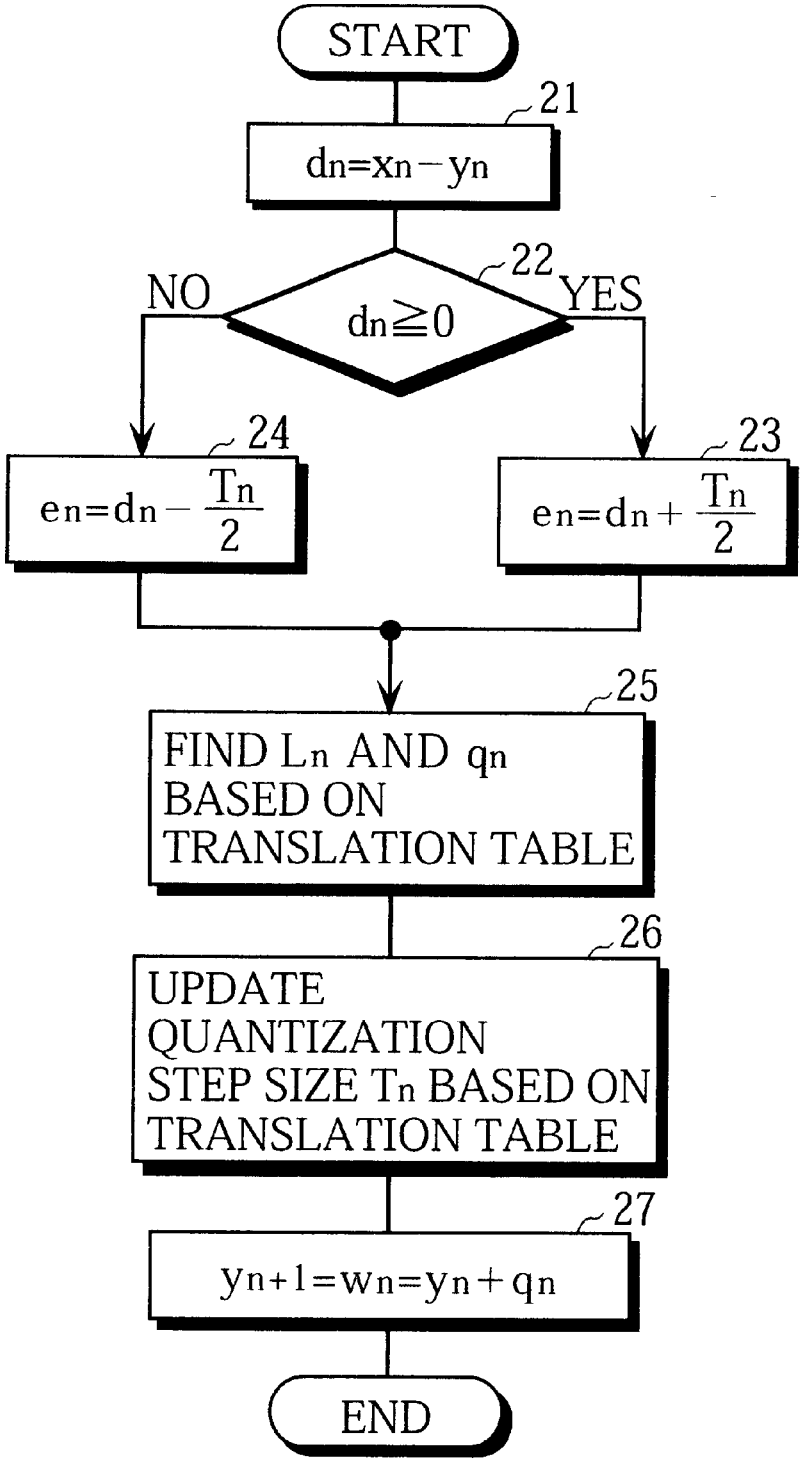
FIG. 7 is a flow chart showing operations performed by an ADPCM encoder shown in FIG. 6.

FIG. 7 shows the procedure for operations performed by the ADPCM encoder 101.

The predicting signal $y_n$ is first subtracted from the input signal $x_n$, to find the first prediction error signal $d_n$ (step 21).

It is then judged whether the first prediction error signal $d_n$ is not less than zero or less than zero (step 22). When the first prediction error signal $d_n$ is not less than zero, one-half of the quantization step size $T_n$ is added to the first prediction error signal $d_n$, to find the second prediction error signal $e_n$ (step 23).

When the first prediction error signal $d_n$ is less than zero, one-half of the quantization step size $T_n$ is subtracted from the first prediction error signal $d_n$, to find the second prediction error signal $e_n$ (step 24).

When the second prediction error signal $e_n$ is found in the step 23 or the step 24, coding and reverse quantization are performed on the basis of the translation table (step 25). That is, the code $L_n$ and the reversely quantized value $q_n$ are found.

The quantization step size $T_n$ is then updated on the basis of the translation table (step 26). The predicting signal $y_{n+1}$ corresponding to the subsequent voice signal sampling value $x_{n+1}$ is found on the basis of the foregoing equation (32) (step 27).

Figure 8:
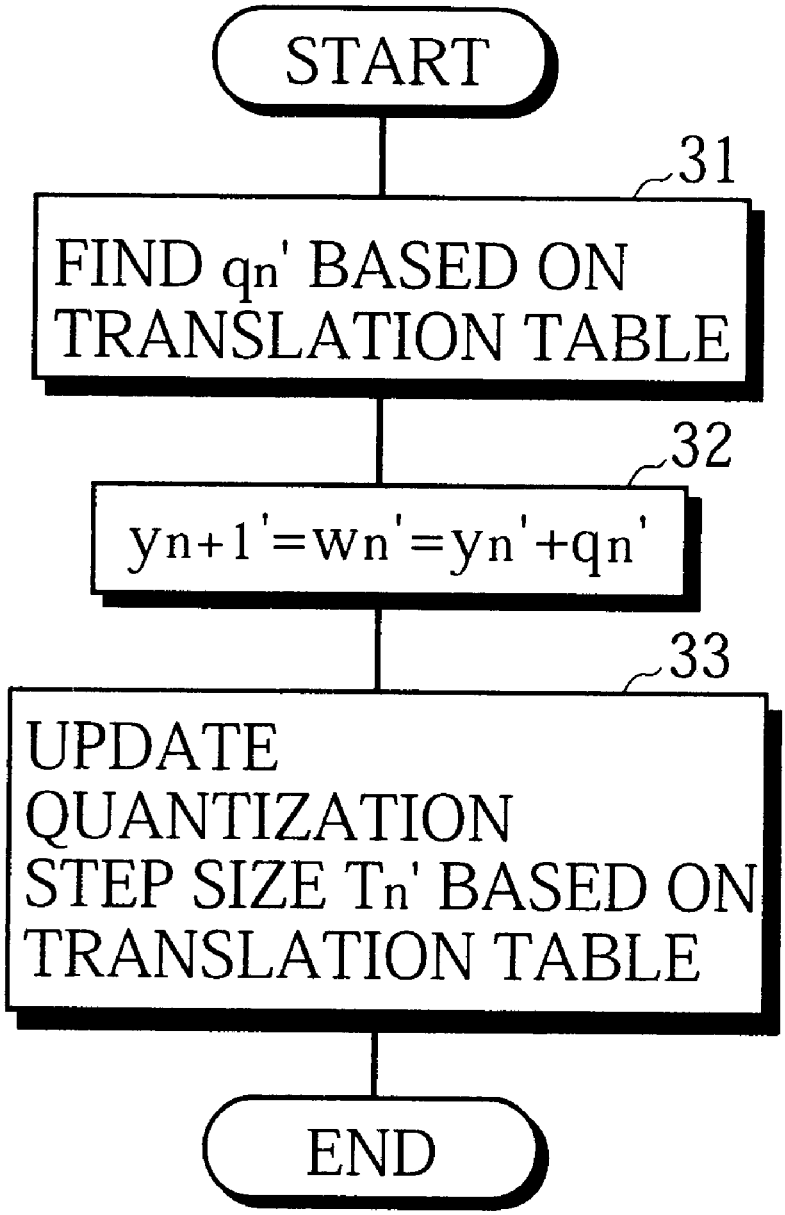
FIG. 8 is a flow chart showing operations performed by an ADPCM decoder shown in FIG. 6.

FIG. 8 shows the procedure for operations performed by the ADPCM decoder 102.

The code $L_n'$ is first read out from the memory 103, to find the reversely quantized value $q_n'$ on the basis of the translation table (step 31).

Thereafter, the subsequent predicting signal $y_{n+1}'$ is found on the basis of the foregoing equation (33) (step 32).

The quantization step size $T_{n+1}'$ used with respect to the subsequent code $L_{n+1}'$ is found on the basis of the translation table (step 33).

Figure 9:
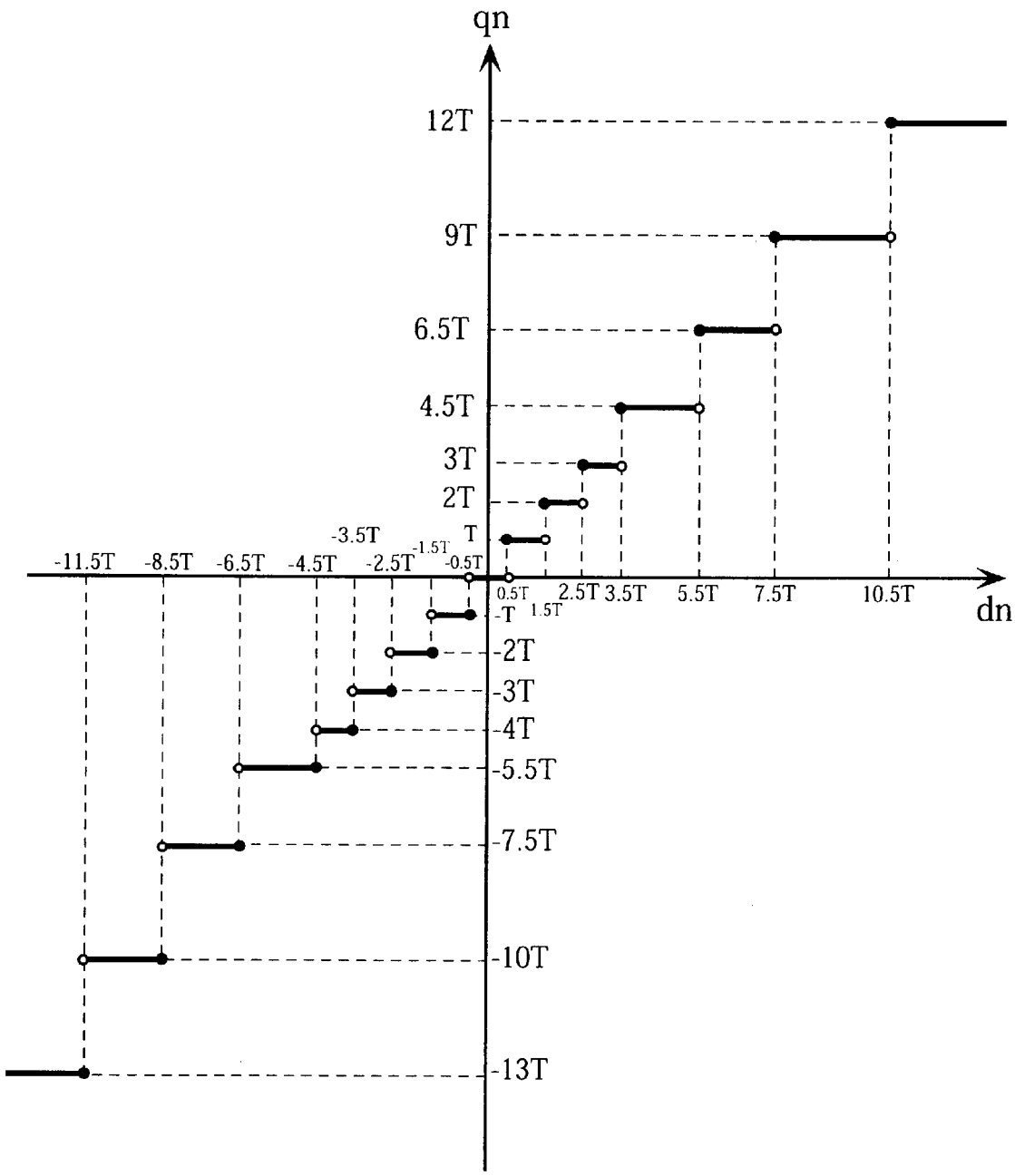
FIG. 9 is a graph showing the relationship between a prediction error signal $d_n$ and a reversely quantized value $q_n$.

FIG. 9 illustrates the relationship between the reversely quantized value $q_n$ obtained by the first adaptive reverse quantizer 115 in the ADPCM encoder 101 and the first prediction error signal $d_n$ in a case where the code $L_n$ is composed of four bits. T represents a quantization step size determined by the first quantization step size updating device 118 at a certain time point.

In a case where the range A to B of the first prediction error signal $d_n$ is indicated by A and B, the range is indicated by "[A" when a boundary A is included in the range, while being indicated by "(A" when it is not included therein. Similarly, the range is indicated by "B]" when a boundary B is included in the range, while being indicated by "B)" when it is not included therein.

The reversely quantized value $q_n$ is zero when the value of the first prediction error signal $d_n$ is in the range of (−0.5T, 0.5T), T when it is in the range of [0.5T, 1.5T), 2T when it is in the range of [1.5T, 2.5T), and 3T when it is in the range of [2.5T, 3.5T).

The reversely quantized value $q_n$ is 4.5T when the value of the first prediction error signal $d_n$ is in the range of [3.5T, 5.5T), and 6.5T when it is in the range of [5.5T, 7.5T). The reversely quantized value $q_n$ is 9T when the value of the first prediction error signal $d_n$ is in the range of [7.5T, 10.5T), and 12T when it is in the range of [10.5T, ∞].

Furthermore, the reversely quantized value $q_n$ is −T when the value of the first prediction error signal $d_n$ is in the range of (−1.5T, 0.5T], −2T when it is in the range of (−2.5T, −1.5T], −3T when it is in the range of (−3.5T, −2.5T], and −4T when it is in the range of (−4.5T, −3.5T].

The reversely quantized value $q_n$ is −5.5T when the value of the first prediction error signal $d_n$ is in the range of (−6.5T, −4.5T], and −7.5T when it is in the range of (−8.5T, −6.5T]. The reversely quantized value $q_n$ is −10T when the value of the first prediction error signal $d_n$ is in the range of (−11.5T, −8.5T], and −13T when it is in the range of [∞, −1.5T].

Also in the second embodiment, the quantization step size $T_n$ is made large when the code $L_n$ becomes large, as can be seen from Table 2. That is, the quantization step size is made small when the prediction error signal $d_n$ is small, while being made large when it is large.

Also in the second embodiment, when the prediction error signal $d_n$ which is a difference between the input signal $x_n$ and the predicting signal $y_n$ is zero, the reversely quantized value $q_n$ is zero, as in the first embodiment. When the prediction error signal $d_n$ is zero as in a silent section of a voice signal, therefore, a quantizing error is decreased.

When the absolute value of the first prediction error signal $d_n$ is rapidly changed from a large value to a small value, a large value corresponding to the previous prediction error signal $d_n$ whose absolute value is large is maintained as the quantization step size. However, the reversely quantized value $q_n$ can be made zero, so that the quantizing error is decreased.

In the first embodiment, the quantization step size at each time point may, in some case, be changed. When the quantization step size is determined at a certain time point, however, the quantization step size is constant irrespective of the absolute value of the prediction error signal $d_n$ at that time point. On the other hand, in the second embodiment, even in a case where the quantization step size $T_n$ is determined at a certain time point, the substantial quantization step size is decreased when the absolute value of the prediction error signal $d_n$ is relatively small, while being increased when the absolute value of the prediction error signal $d_n$ is relatively large.

Therefore, the second embodiment has the advantage that the quantizing error in a case where the absolute value of the prediction error signal $d_n$ is small can be made smaller, as compared with that in the first embodiment. When the absolute value of the prediction error signal $d_n$ is small, a voice may be small in many cases, so that the quantizing error greatly affects the degradation of a reproduced voice. If the quantizing error in a case where the prediction error signal $d_n$ is small can be decreased, therefore, this is useful.

On the other hand, when the absolute value of the prediction error signal $d_n$ is large, a voice may be large in many cases, so that the quantizing error does not greatly affect the degradation of a reproduced voice. Even if the substantial quantization step size is increased in a case where the absolute value of the prediction error signal $d_n$ is relatively large as in the second embodiment, therefore, there are few demerits therefor.

Furthermore, when the absolute value of the prediction error signal $d_n$ is rapidly changed from a small value to a large value, the quantization step size is small. In the second embodiment, when the absolute value of the prediction error signal $d_n$ is large, however, the substantial quantization step size is made larger than the quantization step size, so that the quantizing error can be decreased.

Although in the first embodiment and the second embodiment, description was made of a case where the present invention is applied to the ADPCM, the present invention is applicable to APCM in which the input signal $x_n$ is used as it is in place of the first prediction error signal $d_n$ in the ADPCM.

[3] Description of Third Embodiment

Figure 10:
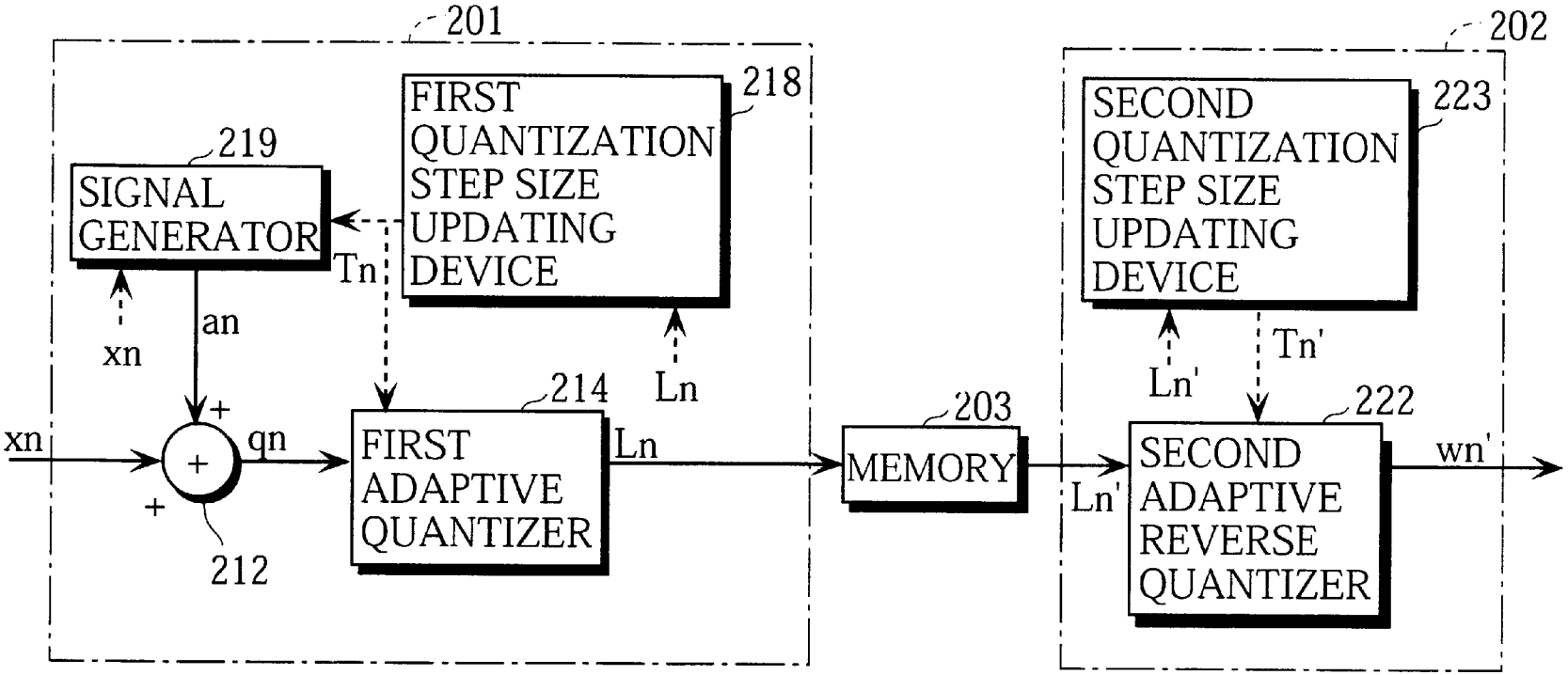
FIG. 10 is a block diagram showing a third embodiment of the present invention.
Figure 11:
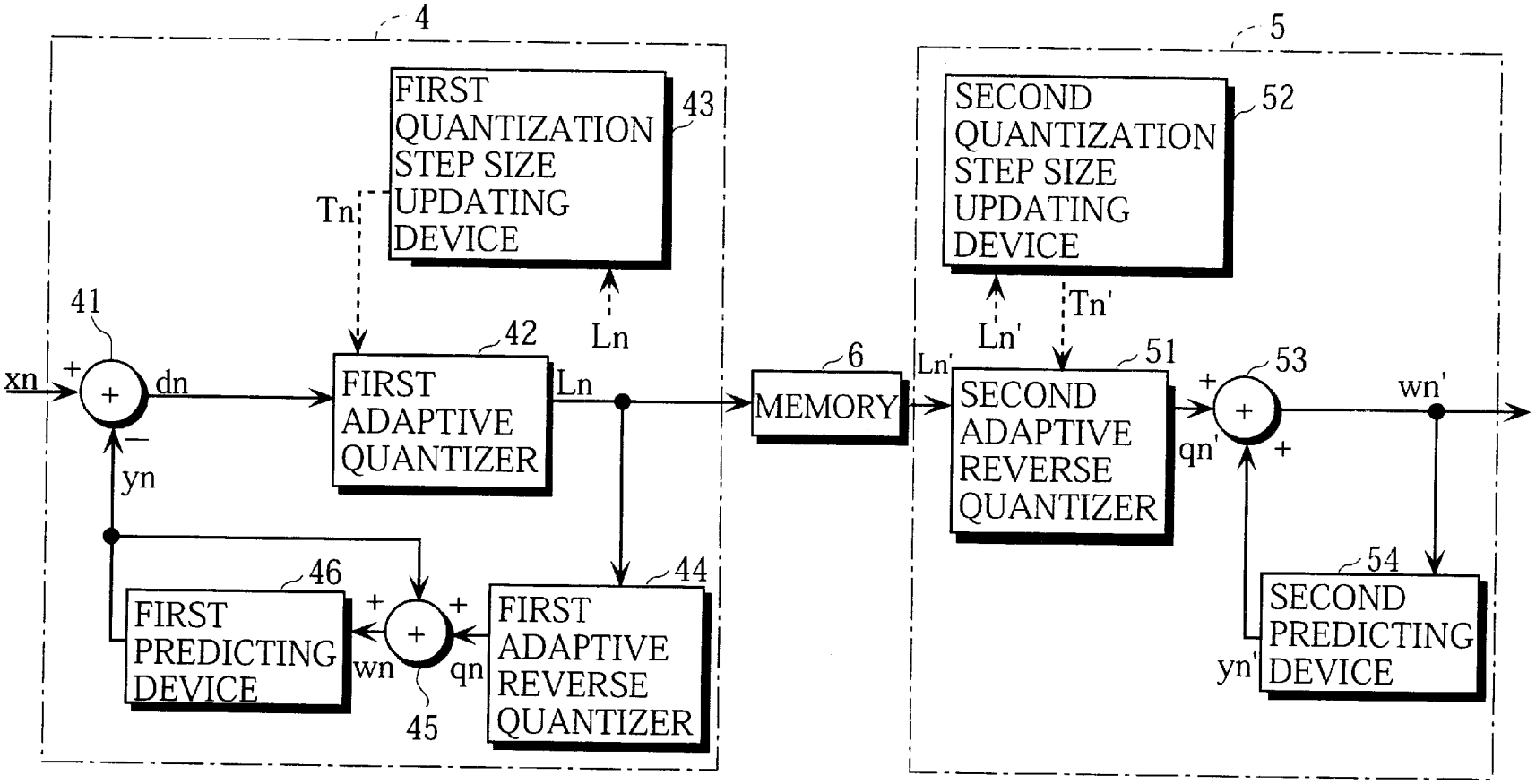
FIG. 11 is a block diagram showing a conventional example.
Figure 12:
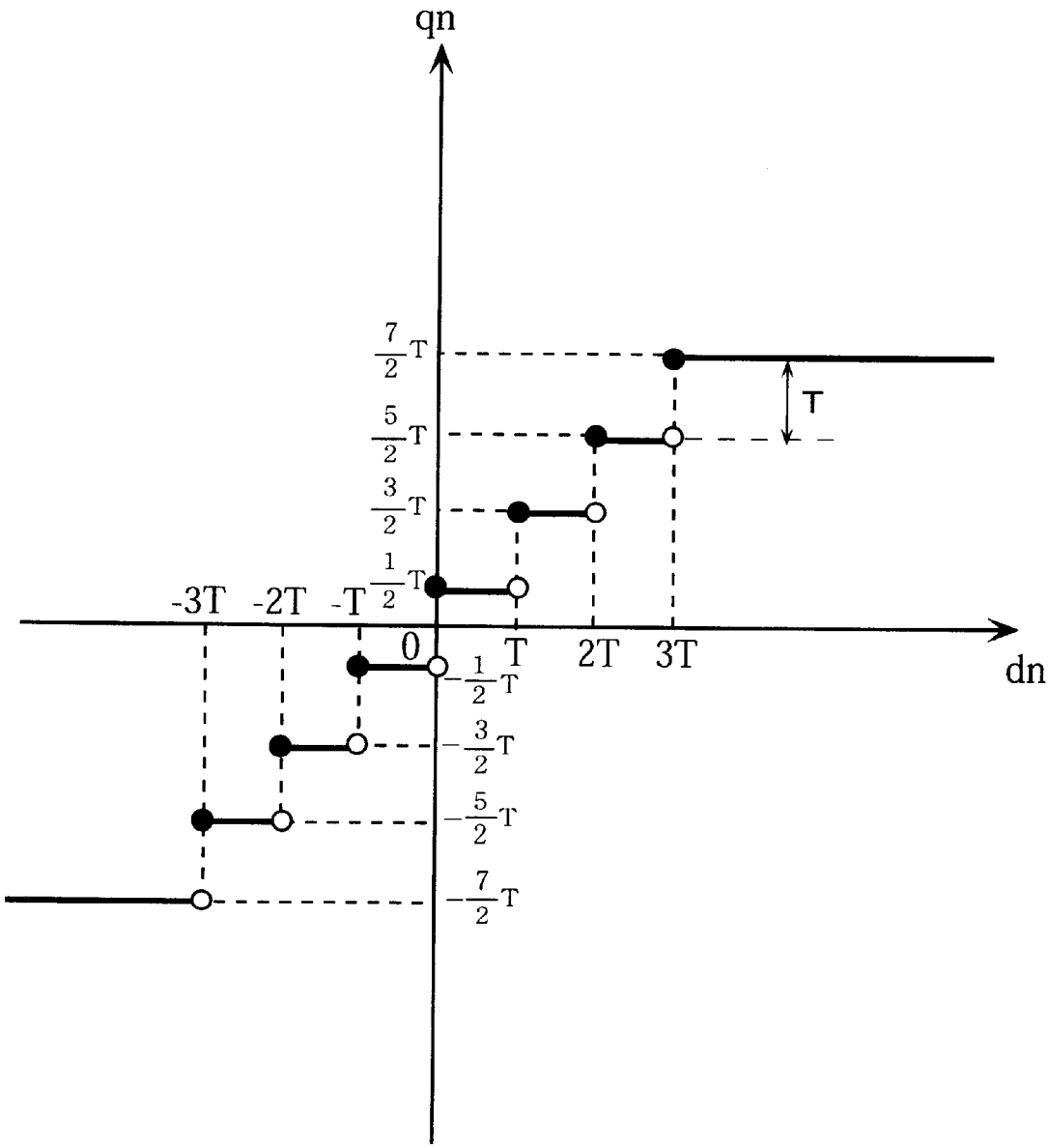
FIG. 12 is a graph showing the relationship between a prediction error signal $d_n$ and a reversely quantized value $q_n$ in the conventional example.
Figure 13:
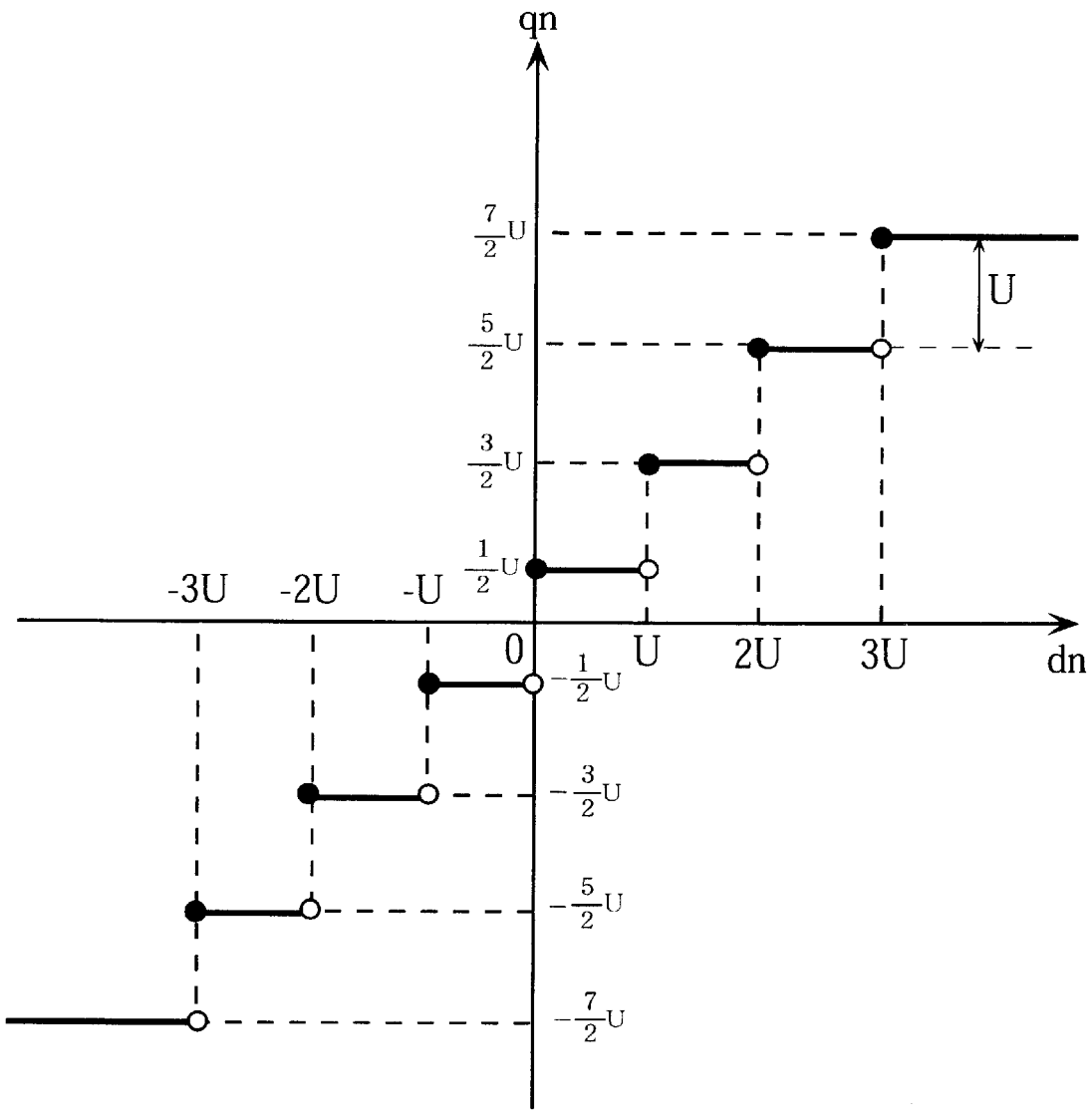
FIG. 13 is a graph showing the relationship between a prediction error signal $d_n$ and a reversely quantized value $q_n$ in the conventional example.

Referring now to FIG. 10, a third embodiment of the present invention will be described.

FIG. 10 illustrates the schematic construction of an APCM encoder 201 and an APCM decoder 202. n used in the following description is an integer.

Description is now made of the APCM encoder 201.

A signal generator 219 generates a correcting signal $a_n$ on the basis of a signal $x_n$ inputted to the APCM encoder 201 and a quantization step size $T_n$ obtained by a first quantization step size updating device 218. That is, the signal generator 219 generates the correcting signal $a_n$ on the basis of the following equation (34):

$$\text{in the case of } x_n \geqq 0\text{: } a_n = T_n/2$$

$$\text{in the case of } x_n < 0\text{: } a_n = -T_n/2 \tag{34}$$

A first adder 212 finds a corrected input signal $g_n$ on the basis of the input signal $x_n$ and the correcting signal $a_n$ obtained by the signal generator 219. That is, the first adder 212 finds the corrected input signal $g_n$ on the basis of the following equation (35):

$$g_n = x_n + a_n \tag{35}$$

Consequently, the corrected input signal $g_n$ is expressed by the following equation (36):

$$\text{in the case of } d_n \geqq 0\text{: } g_n = x_n + T_n/2$$

$$\text{in the case of } d_n < 0\text{: } g_n = x_n - T_n/2 \tag{36}$$

A first adaptive quantizer 214 codes the corrected input signal $g_n$ found by the first adder 212 on the basis of the quantization step size $T_n$ obtained by the first quantization step size updating device 218, to find a code $L_n$. That is, the first adaptive quantizer 214 finds the code $L_n$ on the basis of the following equation (37). The found code $L_n$ is sent to a memory 203.

$$L_n=[g_n/T_n] \quad (37)$$

In the equation (37), [ ] is Gauss' notation, and represents the maximum integer which does not exceed a number in the square brackets. An initial value of the quantization step size $T_n$ is a positive number.

The first quantization step size updating device 218 finds a quantization step size $T_{n+1}$ corresponding to the subsequent voice signal sampling value $x_{n+1}$ on the basis of the following equation (37). The relationship between the code $L_n$ and a function M ($L_n$) is as shown in Table 3. Table 3 shows an example in a case where the code $L_n$ is composed of four bits.

$$T_{n+1}=T_n \times M(L_n) \quad (38)$$

TABLE 3

| $L_n$ | | M ($L_n$) |
|---|---|---|
| 0 | −1 | 0.8 |
| 1 | −2 | 0.8 |
| 2 | −3 | 0.8 |
| 3 | −4 | 0.8 |
| 4 | −5 | 1.2 |
| 5 | −6 | 1.6 |
| 6 | −7 | 2.0 |
| 7 | −8 | 2.4 |

Description is now made of the APCM decoder 202.

A second adaptive reverse quantizer 222 uses a code $L_n'$ obtained from the memory 203 and a quantization step size $T_n'$ obtained by a second quantization step size updating device 223, to find $w_n'$ (a reversely quantized value) on the basis of the following equation (39) The found reproducing signal $w_n'$ is outputted from the APCM decoder 202.

$$w_n'=L_n' \times T_n' \quad (39)$$

The second quantization step size updating device 223 uses the code $L_n'$ obtained from the memory 203, to find a quantization step size $T_{n+1}'$ used with respect to the subsequent code $L_{n+1}'$ on the basis of the following equation (40). The relationship between the code $L_n'$ and a function M ($L_n'$) is the same as the relationship between the code $L_n$ and the function M ($L_n$) in Table 3.

$$T_{n+1}'=T_n \times M(L_n') \quad (40)$$

In the third embodiment, a reproducing signal $w_n'$ obtained by reversely quantizing the code $L_n$ corresponding to a section where the absolute value of the input signal $x_n$ is small is approximately zero.

In the above-mentioned third embodiment, the code $L_n$ may be found on the basis of the corrected input signal $g_n$ and a table previously storing the relationship between the signal $g_n$ and the code $L_n$, and the quantization step size $T_{n+1}$ corresponding to the subsequent input signal $x_{n+1}$ may be found on the basis of the found code $L_n$ and a table previously storing the relationship between the code $L_n$ and the quantization step size $T_{n+1}$ corresponding to the subsequent input signal $x_{n+1}$.

In this case, the respective tables storing the relationship between the signal $g_n$ and the code $L_n$ and the relationship between the code $L_n$ and the quantization step size $T_{n+1}$ corresponding to the subsequent input signal $x_{n+1}$ are produced so as to satisfy the following conditions (a), (b), and (c):

(a) the quantization step size $T_n$ is so changed as to be increased when the absolute value of the input signal $x_n$ is so changed as to be increased.

(b) the reproducing signal $w_n'$ obtained by reversely quantizing the code $L_n$ corresponding to the section where the absolute value of the input signal $x_n$ is small is approximately zero.

(c) the substantial quantization step size corresponding to a section where the absolute value of the input signal $x_n$ is large is larger, as compared with that corresponding to the section where the absolute value of the input signal $x_n$ is small.

Industrial Applicability

A voice coding method according to the present invention is suitable for use in voice coding methods such as ADPCM and APCM.

What is claimed is:

1. A voice coding method comprising:

the first step of adding, when a first prediction error signal $d_n$ which is a difference between an input signal $x_n$ and a predicted value $y_n$ corresponding to the input signal $x_n$ is not less than zero, one-half of a quantization step size $T_n$ to the first prediction error signal $d_n$ to produce a second prediction error signal $e_n$, while subtracting, when the first prediction error signal $d_n$ is less than zero, one-half of the quantization step size $T_n$ from the first prediction error signal $d_n$ to produce a second prediction error signal $e_n$;

the second step of finding a code $L_n$ on the basis of the second prediction error signal $e_n$ found in the first step and the quantization step size $T_n$;

the third step of finding a reversely quantized value $q_n$ on the basis of the code $L_n$ found in the second step;

the fourth step of finding a quantization step size $T_{n+1}$ corresponding to the subsequent input signal $x_{n+1}$ on the basis of the code $L_n$ found in the second step; and the fifth step of finding a predicted value $y_{n+1}$ corresponding to the subsequent input signal $x_{n+1}$ on the basis of the reversely quantized value $q_n$ found in the third step and the predicted value $y_n$.

2. The voice coding method according to claim 1, wherein in said second step, the code $L_n$ is found on the basis of the following equation:

$$L_n=[e_n/T_n]$$

where [ ] is Gauss' notation, and represents the maximum integer which does not exceed a number in the square brackets.

3. The voice coding method according to claim 1, wherein in said third step, the reversely quantized value $q_n$ is found on the basis of the following equation:

$$g_n=L_n \times T_n.$$

4. The voice coding method according to claim 1, wherein in said fourth step, the quantization step size $T_{n+1}$ is found on the basis of the following equation:

$$T_{n+1}=T_n \times M(L_n)$$

where M ($L_n$) is a value determined depending on $L_n$.

5. The voice coding method according to claim 1, wherein in said fifth step, the predicted value $y_{n+1}$ is found on the basis of the following equation:

$y_{n+1}=y_n+q_n$.

6. A voice coding method comprising:

the first step of adding, when a first prediction error signal $d_n$ which is a difference between an input signal $x_n$ and a predicted value $y_n$ corresponding to the input signal $x_n$ is not less than zero, one-half of a quantization step size $T_n$ to the first prediction error signal $d_n$ to produce a second prediction error signal $e_n$, while subtracting, when the first prediction error signal $d_n$ is less than zero, one-half of the quantization step size $T_n$ from the first prediction error signal $d_n$ to produce a second prediction error signal $e_n$;

the second step of finding, on the basis of the second prediction error signal $e_n$ found in the first step and a table previously storing the relationship between the second prediction error signal $e_n$ and a code $L_n$, the code $L_n$;

the third step of finding, on the basis of the code $L_n$ found in the second step and a table previously storing the relationship between the code $L_n$ and a reversely quantized value $q_n$, the reversely quantized value $q_n$;

the fourth step of finding, on the basis of the code $L_n$ found in the second step and a table previously storing the relationship between the code $L_n$ and a quantization step size $T_{n+1}$ corresponding to the subsequent input signal $x_{n+1}$, the quantization step size $T_{n+1}$ corresponding to the subsequent input signal $x_{n+1}$; and the fifth step of finding a predicted value $y_{n+1}$ corresponding to the subsequent input signal $x_{n+1}$ on the basis of the reversely quantized value $q_n$ found in the third step and the predicted value $y_n$, wherein each of the tables being produced so as to satisfy the following conditions (a), (b) and (c):

(a) The quantization step size $T_n$ is so changed as to be increased when the absolute value of the difference $d_n$ is so changed as to be increased, (b) The reversely quantized value $q_n$ of the code $L_n$ corresponding to a section where the absolute value of the difference $d_n$ is small is approximately zero, and (c) A substantial quantization step size corresponding to a section where the absolute value of the difference $d_n$ is large is larger, as compared with that corresponding to the section where the absolute value of the difference $d_n$ is small.

7. The voice coding method according to claim 6, wherein in said fifth step, the predicted value $y_{n+1}$ is found on the basis of the following equation:

$y_{n+1}=y_n+q_n$.

* * * * *